US009797585B2

(12) United States Patent
Leshniak et al.

(10) Patent No.: US 9,797,585 B2
(45) Date of Patent: Oct. 24, 2017

(54) SYSTEMS AND METHODS FOR RETROFITTING EXISTING LIGHTING SYSTEMS

(71) Applicant: AMERLUX LLC, Oakland, NJ (US)

(72) Inventors: Itai Leshniak, Fair Lawn, NJ (US); Tori Poppenheimer, Cambria, CA (US)

(73) Assignee: AMERLUX LLC, Oakland, NJ (US)

( * ) Notice: Subject to any disclaimer, the term of this patent is extended or adjusted under 35 U.S.C. 154(b) by 164 days.

(21) Appl. No.: 14/578,811

(22) Filed: Dec. 22, 2014

(65) Prior Publication Data

US 2015/0176823 A1 Jun. 25, 2015

Related U.S. Application Data

(60) Provisional application No. 61/920,608, filed on Dec. 24, 2013.

(51) Int. Cl.
*F21S 8/00* (2006.01)
*F21V 21/14* (2006.01)
(Continued)

(52) U.S. Cl.
CPC ..... *F21V 21/14* (2013.01); *F21K 9/20* (2016.08); *F21S 8/04* (2013.01); *F21S 8/043* (2013.01);
(Continued)

(58) Field of Classification Search
CPC ..... F21S 48/1258; F21S 48/2231; F21S 48/2281; E04B 9/006
See application file for complete search history.

(56) References Cited

U.S. PATENT DOCUMENTS 2,516,661 A * 7/1950 Versen ..... F21V 21/02 248/343
5,897,201 A * 4/1999 Simon ..... F21V 5/00 362/147
(Continued)

FOREIGN PATENT DOCUMENTS

EP 2315497 A1 4/2011
JP H02-293713 A 12/1990
(Continued)

OTHER PUBLICATIONS

International Search Report and Written Opinion in related International application No. PCT/US2014/071807, dated Apr. 23, 2015.

*Primary Examiner* — Jong-Suk (James) Lee
*Assistant Examiner* — Zheng Song
(74) *Attorney, Agent, or Firm* — Day Pitney LLP

(57) ABSTRACT

LED lighting systems and methods for retro-fitting existing lighting systems such as acorn and other globe style fixtures is disclosed. The retro-fit systems can be provided with an LED driver, an adaptor casting which mounts to industry standard fixture, a riser for adjusting the height of the lighting fixture, and an assembly of an optically active sealing lens, a heat sink and a LED board, wherein the LED lights, which can be made up of a plurality of LEDs, are arranged in concentric rings on the LED board, and are fitted with a sealing lens in the form of a rotated bubble optic with concentric grooves on the inner surface.

11 Claims, 19 Drawing Sheets

(51) Int. Cl.

| | |
|---|---|
| ***H05B 33/08*** | (2006.01) |
| ***F21V 5/04*** | (2006.01) |
| ***F21V 29/77*** | (2015.01) |
| ***H05B 33/10*** | (2006.01) |
| ***F21S 8/06*** | (2006.01) |
| ***F21S 8/04*** | (2006.01) |
| ***F21V 21/03*** | (2006.01) |
| ***F21K 9/20*** | (2016.01) |
| *F21V 5/08* | (2006.01) |
| *F21V 21/02* | (2006.01) |
| *F21V 5/00* | (2015.01) |
| *F21Y 115/10* | (2016.01) |

(52) U.S. Cl.

CPC ..... *F21S 8/06* (2013.01); *F21S 8/063* (2013.01); *F21V 5/045* (2013.01); *F21V 21/03* (2013.01); *F21V 29/77* (2015.01); *F21V 29/777* (2015.01); *H05B 33/0887* (2013.01); *H05B 33/10* (2013.01); *F21V 5/007* (2013.01); *F21V 5/04* (2013.01); *F21V 5/08* (2013.01); *F21V 21/02* (2013.01); *F21Y 2115/10* (2016.08); *Y10T 29/49117* (2015.01)

(56) References Cited

U.S. PATENT DOCUMENTS

| | | | | |
|---|---|---|---|---|
| 6,536,921 | B1 * | 3/2003 | Simon | F21S 6/005 362/268 |
| 6,614,358 | B1 | 9/2003 | Hutchison et al. | |
| 8,111,011 | B1 | 2/2012 | Tu et al. | |
| 2006/0034094 | A1 * | 2/2006 | Asada | F21S 48/215 362/545 |
| 2011/0309751 | A1 * | 12/2011 | Ter-Hovhannisyan | F21V 29/004 315/113 |
| 2012/0106134 | A1 * | 5/2012 | Chang | F21S 8/06 362/147 |
| 2013/0042510 | A1 | 2/2013 | Nall et al. | |
| 2013/0044480 | A1 * | 2/2013 | Sato | F21S 8/061 362/235 |
| 2013/0051010 | A1 * | 2/2013 | Nakamura | F21V 5/007 362/235 |
| 2013/0058075 | A1 * | 3/2013 | Wang | F21S 8/061 362/147 |
| 2013/0229803 | A1 | 9/2013 | Taklak | |
| 2014/0177227 | A1 * | 6/2014 | Kim | F21S 8/063 362/294 |
| 2014/0286017 | A1 * | 9/2014 | Morgan | H01L 31/0525 362/308 |
| 2015/0092449 | A1 * | 4/2015 | Demuynck | H05B 33/0803 362/649 |

FOREIGN PATENT DOCUMENTS

| | | | |
|---|---|---|---|
| JP | 3173746 | U | 1/2012 |
| WO | 2009/076770 | A1 | 6/2009 |
| WO | 2011/156779 | A1 | 12/2011 |
| WO | 2012/122095 | A2 | 9/2012 |
| WO | 2012/147026 | A1 | 11/2012 |

* cited by examiner

Light distribution recorded with complete fixture fitter and globe in wavy, non-refractive polycarbonate globe material.

SYSTEMS AND METHODS FOR RETROFITTING EXISTING LIGHTING SYSTEMS

FIELD

The present disclosure relates to systems and methods for retrofitting existing lighting systems.

BACKGROUND

Lighting systems with acorn and other globe style fixtures are sometimes used for downtown or boardwalk areas. Typically, these street lighting systems are constructed with the fixtures sitting on top of omniscient directional light bulbs, protecting the bulbs from weather elements, such as lightning or rain. Conventional roadway type light fixtures distribute light by using individual bubble type optics over individual LEDs with one optic per LED device, which inhibits optimal distribution of light emitted from the individual LEDs. Because the omniscient directional light bulbs illuminate upwardly, less light is directed to pathways surrounding the street lights, creating light pollution and wasting energy.

SUMMARY OF THE DISCLOSURE

LED lighting systems and methods for retro-fitting existing lighting systems, such as those with acorn and other globe style fixtures are disclosed. The retro-fit systems and methods can be provided with an LED driver, an adaptor casting which mounts to an industry standard fixture, a riser for adjusting the height of the lighting system, and an assembly of optically active lighting elements in a sealing lens, a heat sink and an LED board.

In one embodiment, the LEDs, which can be implemented as a plurality of LED dies, are arranged in two concentric rings on the LED board, which is fitted with a sealing lens in the form of an annular lens, or "bubble optic," with concentric grooves on the inner surface of the lens that complement the two concentric rings on the LED board. The grooves form entry windows that are the first surfaces through which light emitted out of the LED lights passes wherein the rings of LED lights effectively operate as continuous circles of light instead of point sources of light. In this manner, the circular optic lens collects light from the LEDs and direct them to illuminate along paths projected through the light exit windows on the outer surface of the lens.

In accordance with one aspect of the present disclosure, the LED lights can be protected by at least one sealant surrounding the optic lens. In a preferred embodiment, epoxy sealant is poured into an outer ring in the heat sink in the assembly before the optic lens is depressed and fitted into the heat sink to provide a permanently sealed outer edge and an encapsulated light fixture. Epoxy can also be poured into an inner well of the assembly of the heat sink and optic lens, covering wires that conduct power and permanently sealing the inner edge of the assembly. The sealant can flow into an inner space of the inner well up to a level measured on the outside of the riser to be sufficient to provide a robust permanent seal. In a preferred embodiment, the heat sink can have an opening in its center through which a riser, such as a pipe, can be inserted, and a passage for wires to route past the riser. The heat sink can be made out of cast aluminum. In another embodiment, a ring or a bump can be provided on the inner edge of the heat sink to prevent the sealant from leaking into the air filled optical gap between the LEDs and the annular lens.

In accordance with another aspect of the present disclosure, a high voltage Power Factor Correction (PFC) driver can be used as the LED driver. The high voltage PFC driver provides high efficiency power to the LEDs but requires low current, therefore providing low electrical power consumption. The PFC driver extracts only the amount of energy necessary to drive the LEDs. In a preferred embodiment, the LEDs are connected in a series network. The high voltage supply thus permits lower power consumption, particularly in a standby mode when light is not emitted. In a preferred embodiment, a surge protector, e.g., 10 kA, is provided to protect the lighting system against lightning.

In accordance with yet another aspect of the present disclosure, the LED board includes a resistor to set the appropriate current for the lights. In a preferred embodiment, a "R sense" resistor can be hardwired to the LED board for this purpose.

In accordance with yet another aspect of the present disclosure, a daughter board with a generic connector featuring an interface to the LED driver can be included. The daughter board can include a variety of additional communication protocols to the LEDs, and can be interchangeable with another daughter board with other communication protocols.

Various other aspects and embodiments of the present disclosure are described in further detail below. It has been contemplated that features of one embodiment of the disclosure may be incorporated in other embodiments thereof without further recitation.

The Summary is neither intended nor should it be construed being representative of the full extent and scope of the present disclosure. All objects, features and advantages of the present disclosure will become apparent in the following detailed written description and in conjunction with the accompanying drawings.

Figure 1:
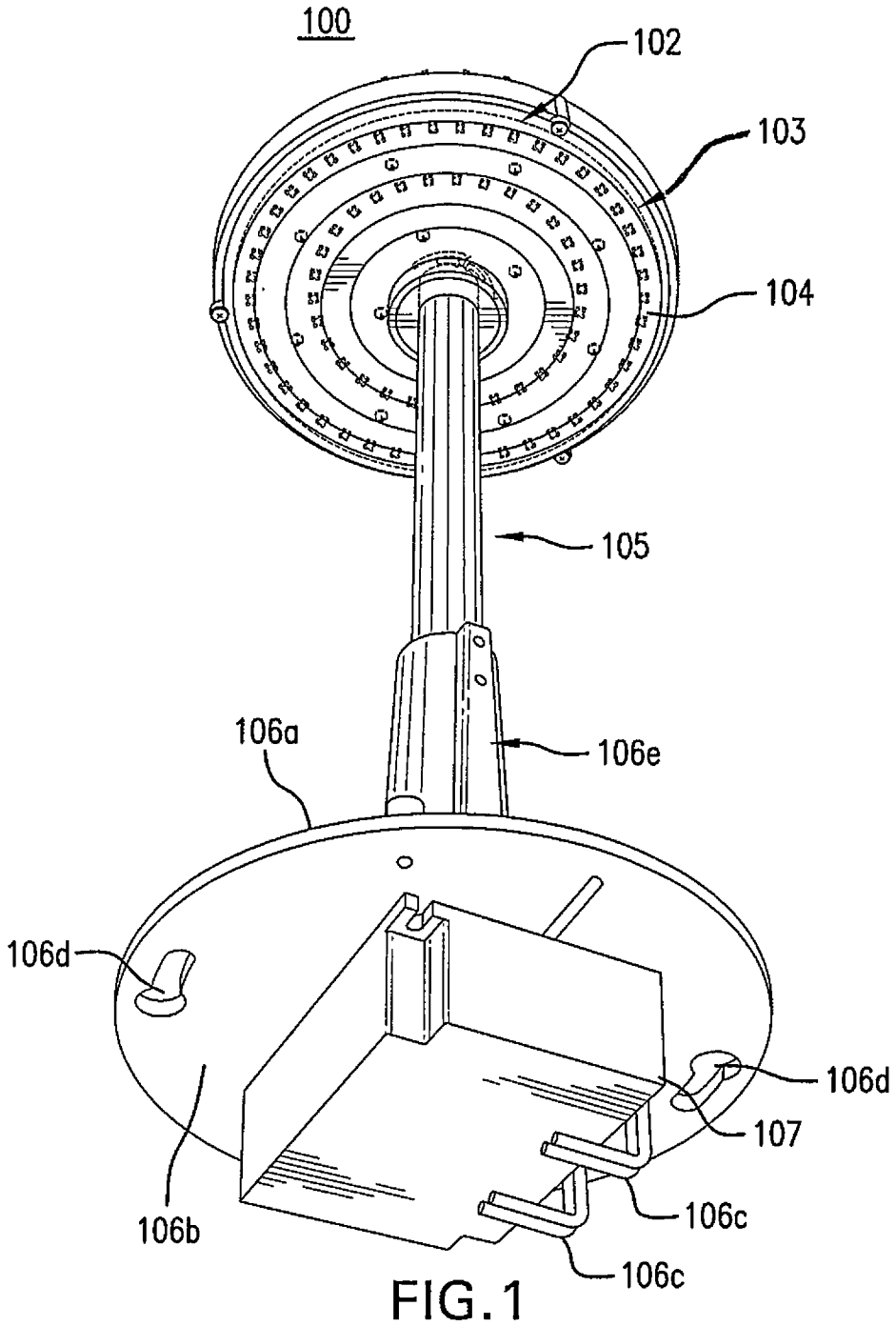
FIG. 1 illustrates a LED lighting retro-fit device for use with existing lighting systems that use acorn or other globe style fixtures according to one embodiment of the present disclosure.

The images in the drawings are simplified for illustrative purposes and are not depicted to scale. To facilitate understanding, identical reference numerals are used in the drawings to designate, where possible, substantially identical elements that are common to the figures, except that alphanumerical extensions and/or suffixes may be added, when appropriate, to differentiate such elements.

DETAILED DESCRIPTION

For purpose of explanation and illustration, and not limitation, an exemplary embodiment of the retro-fit lighting system is shown in FIG. 1, and is designated generally by reference number 100. This exemplary embodiment is also depicted in FIGS. 2-12.

Generally, as illustrated in FIG. 1, a retro-fit LED slighting device 100 of the present disclosure includes a retro-fit assembly 101 which includes an aluminum heat sink 102, a LED board 103, an optically active sealing lens 104, and an aluminum riser pipe 105. Alternative embodiments or variations of retro-fit device 100 can further include an adaptor casting 106 and an LED driver 107, as shown in FIG. 1.

Figure 12:
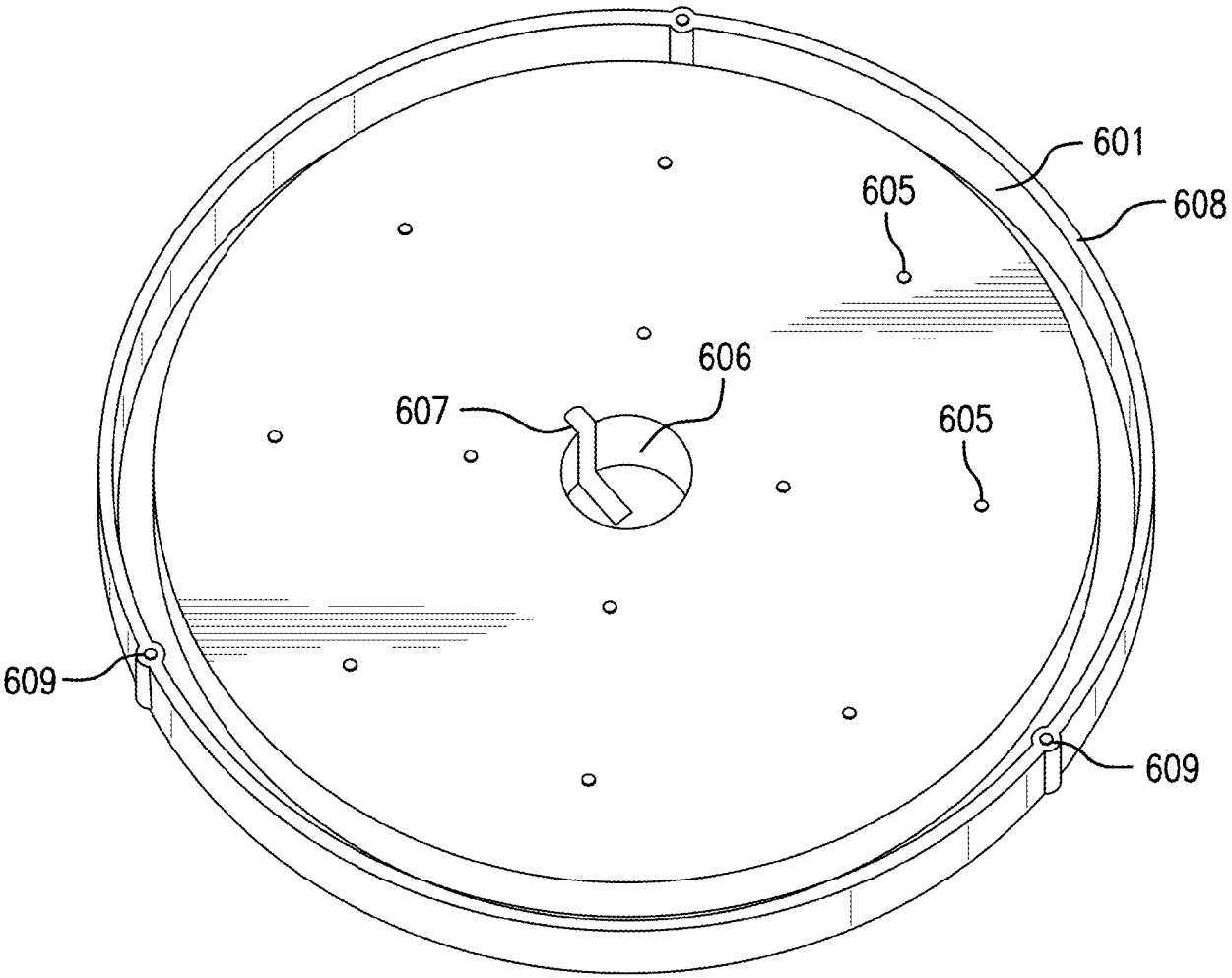
FIG. 12 illustrates a preferred embodiment of the heat sink with an inner well where a passage for routing electrical wires past the riser is included.

In a preferred embodiment, the aluminum heat sink 102 is a circular plate with a raised annular edge 608 on one side of the plate, as illustrated in FIG. 12, sealed with a complementary circular LED board 103 and circular optically active sealing lens 104 encapsulated along the concentric outer ring of heat sink 102. Heat sink 102, LED board 103, and sealing lens 104 are all provided with a center opening, 103*h*, 602, and 403, respectively, to accommodate riser pipe 105 to be fitted through retro-fit assembly 101 on one end of riser pipe 105. On the other end, riser pipe 105 is fitted inside a hollow receiving shaft 106*e* of an adaptor casting 106 to allow adjustable height for lighting system 100. While one side of adaptor casting 106 is mounted onto riser pipe 105 via integral receiving shaft 106*e*, the other side of adaptor casting 106 is provided with a plurality of holding members for retaining LED driver 107 in place, as illustrated in FIG. 1.

In further accordance with the present disclosure, the retro-fit lighting system includes a LED circuit board which, in the preferred embodiment, is secured onto a planar surface of heat sink 102.

Figure 2:
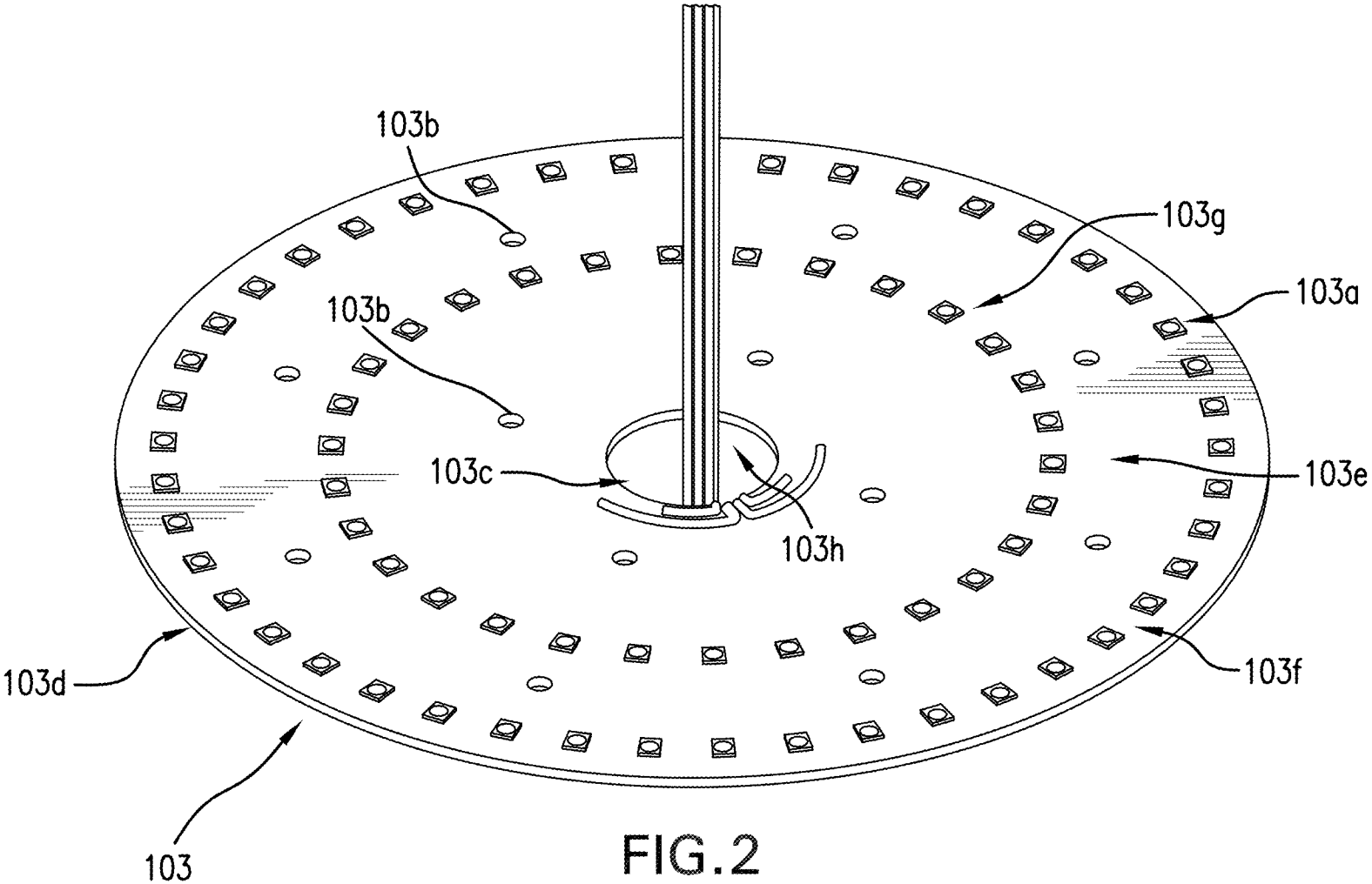
FIG. 2 illustrates a design of an LED board with two concentric rings of LED lights according to a preferred embodiment of the present disclosure.

In a preferred embodiment, as shown in FIG. 2, LED board 103 is a MCPCBA LED circuit board designed to accommodate two concentric rings of LEDs 103*a*, 103*g*. LED board 103 is a circular plate with two opposing planar surfaces 103*e* and 103*f*, an outer periphery 103*d*, and an inner periphery 103*c*. Inner periphery 103*c* forms a circular opening 103*h* at the center of the planar surfaces to accommodate riser pipe 105. LED board 103 is provided with two concentric rings 103*a* and 103*g* of LEDs. LED board 103 also contains a ring of openings 103*b* between the two concentric rings of LED openings 103*a* and 103*g* for securing the LED board to another structure, and an additional ring of securing openings 103*b* between the inner ring of LED opening 103*g* and the center opening 103*h*.

In further accordance with the present disclosure, the retro-fit lighting system also includes an optically active sealing lens, or "annular lens," 104 encapsulated along the outer ring of heat sink 102.

Figure 3:
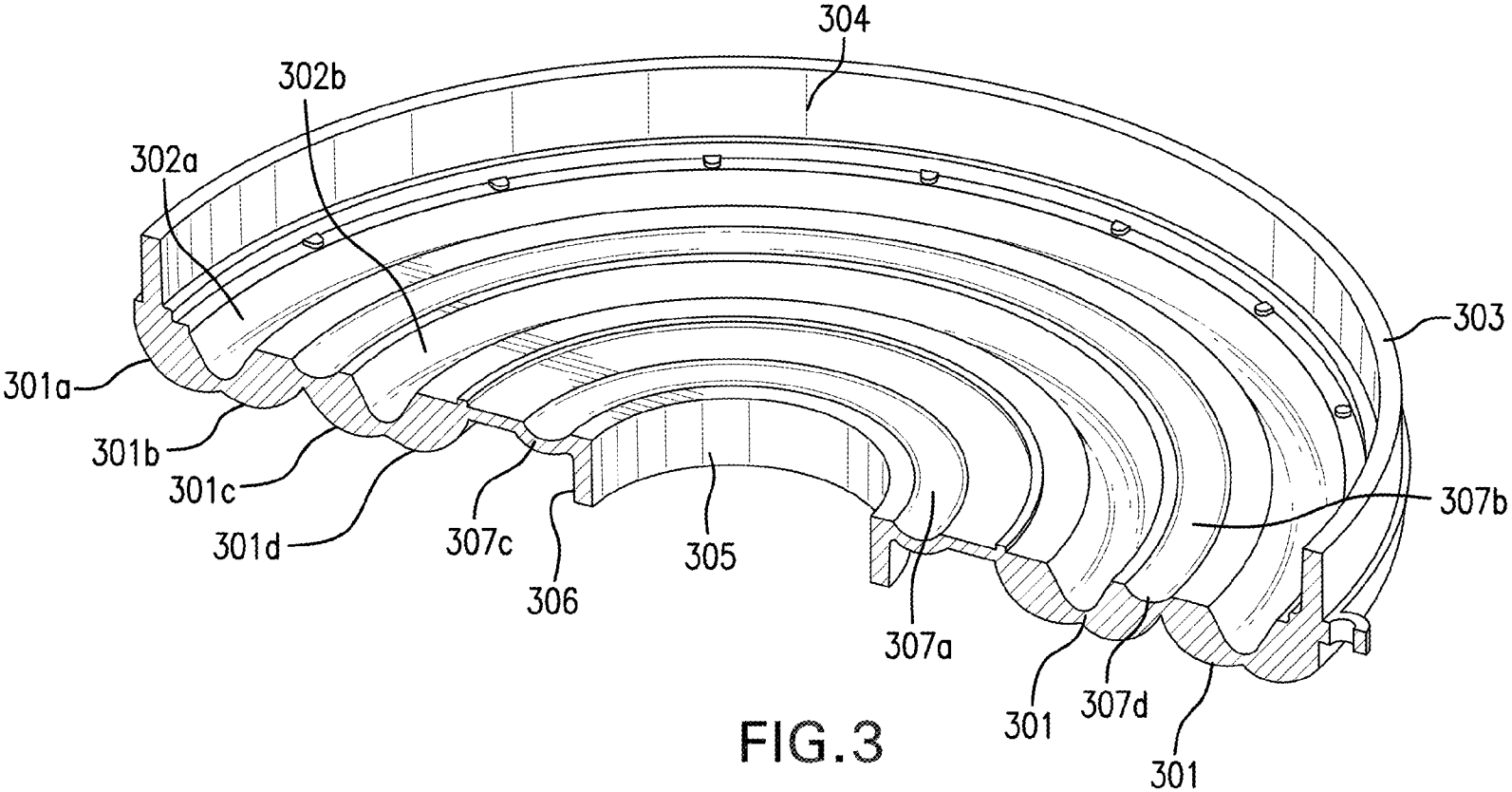
FIG. 3 illustrates a cross-sectional view of the inner surface of an annular lens for a retro-fit device for lighting systems according to one embodiment of the present disclosure.

As seen in the exemplary embodiment in FIG. 3, which illustrates the cross-section of the inner surface of a sealing lens according to one embodiment of the present disclosure, sealing lens 104 is a circular fixture with concentric grooves 302*a* and 302*b* on its inner surface that complement and align with the two concentric rings 103*a* and 103*g* on the LED board, respectively. The concentric grooves 302*a* and 302*b* are shaped to capture light emitted from the two concentric rings of LEDs. Sealing lens 104 uses the primary working cross-section of a bubble optic and rotates it into concentric rings, which helps the rings of LEDs to emit continuous circles of light from lens 104. Accordingly, the cross-section of the concentric grooves 302*a* and 302*b* of sealing lens 104, viewed with the inner surface of the sealing lens upward, is shaped in a plurality of crescent waves with sections of concentric toroidal surfaces 301*a*, 301*b*, 301*c*, and 301*d* at the bottom. Concentric toroidal surfaces 301*a* and 301*b* are shaped to provide concentric groove 302*a*, while concentric toroidal surfaces 301*c* and 301*d* are shaped to provide concentric groove 302*b*. The concentric grooves form entry windows 401*a* and 401*b* for illumination from LEDs, as shown in FIG. 4, which is distributed through light exit windows 501*a* and 501*b* on the outer surface of sealing lens 104, as illustrated in FIG. 5.

Sealing lens 104 is also provided with concentric grooves 307*a* and 307*b*, constructed as a result of, respectively, crescent shapes 307*c* and 307*d*. Grooves 307*a* and 307*b* provide clearance for heads of mounting screws.

Sealing lens 104 is further provided with a concentric raised outer wall 304 with outer periphery 303 circling the outer most edge of the lens, as illustrated in FIG. 3. A concentric raised inner wall 305 circles the center opening 403 of sealing lens 104. The cross-section of inner wall 305 has a height of cross-sectional periphery 306.

Figure 4:
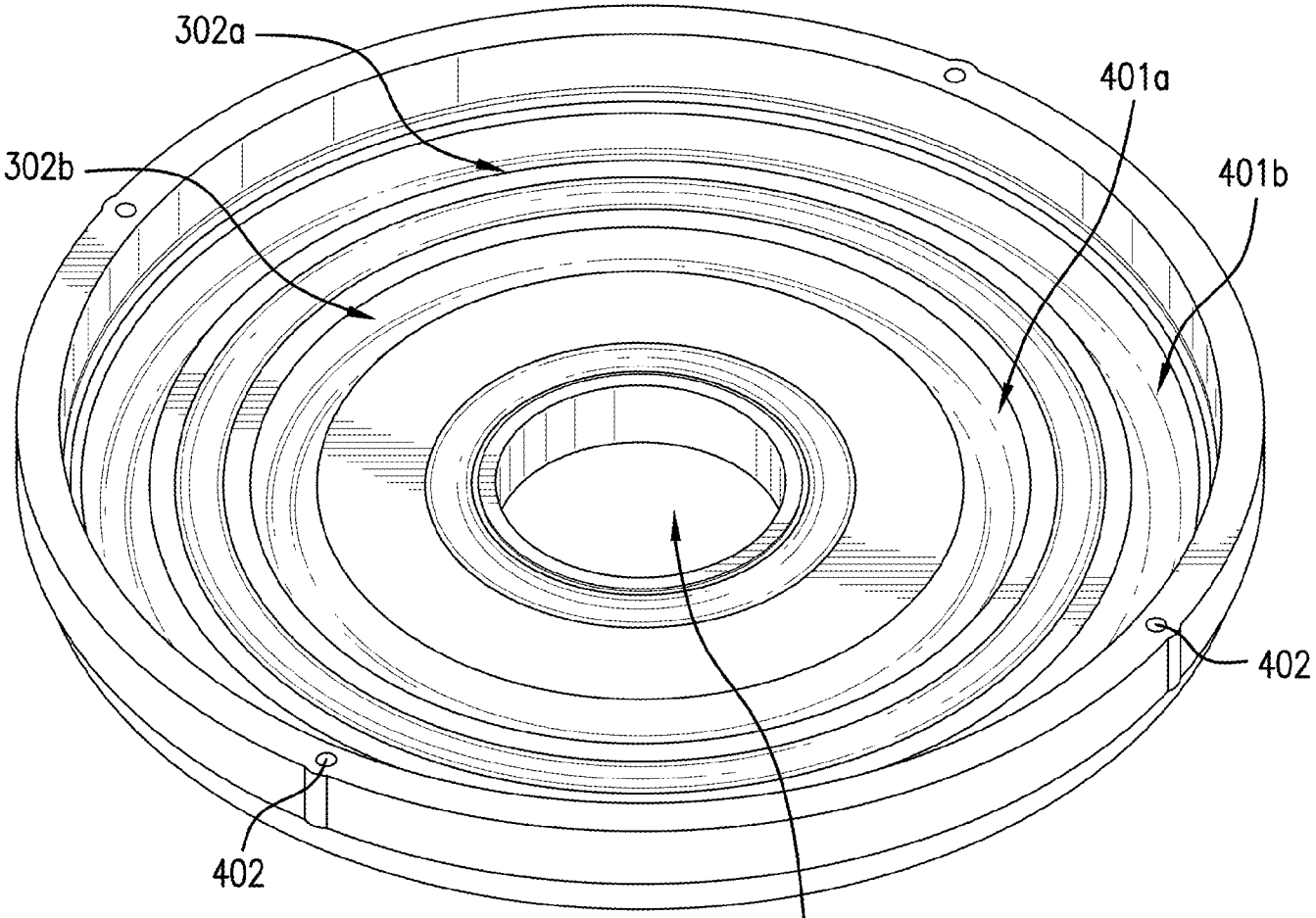
FIG. 4 illustrates the full inner surface of the annular lens designed with light entry windows for LEDs according one embodiment of the present disclosure.
Figure 5:
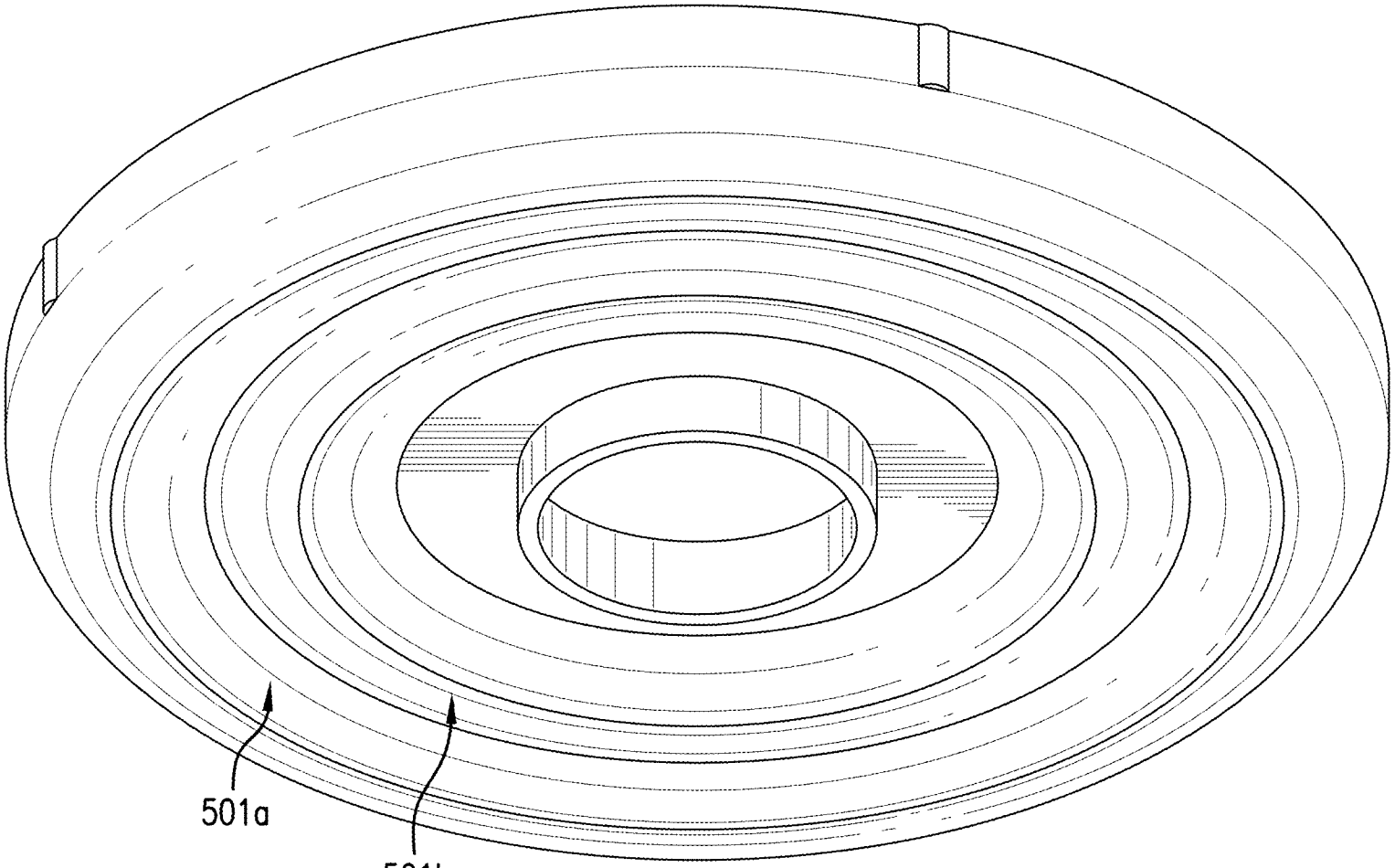
FIG. 5 illustrates the outer surface of the sealing lens that includes light exit windows for distribution of LED light.

As seen in the exemplary embodiment in FIG. 4, the inner surface of sealing lens 104 contains entry windows 401*a* and 401*b*, formed by concentric grooves 302*a* and 302*b*, which are the first surfaces through which the light emitted from LED lights passes from air into a clear solid material. Entry windows 401*a* and 401*b* also correspond to exit windows 501*a* and 501*b*, respectively, as illustrated on the outer surface of sealing lens 104 as shown in FIG. 5. In the illustrated embodiment, sealing lens 104 is also provided with securing openings 402 along outer periphery 303 for fastening sealing lens 104 to heat sink 102 with screws.

In accordance with the present disclosure, the retro-fit lighting system also includes a heat sink 102, which is coupled to LED board 103, and also receives and is sealed with sealing lens 104.

Figure 6:
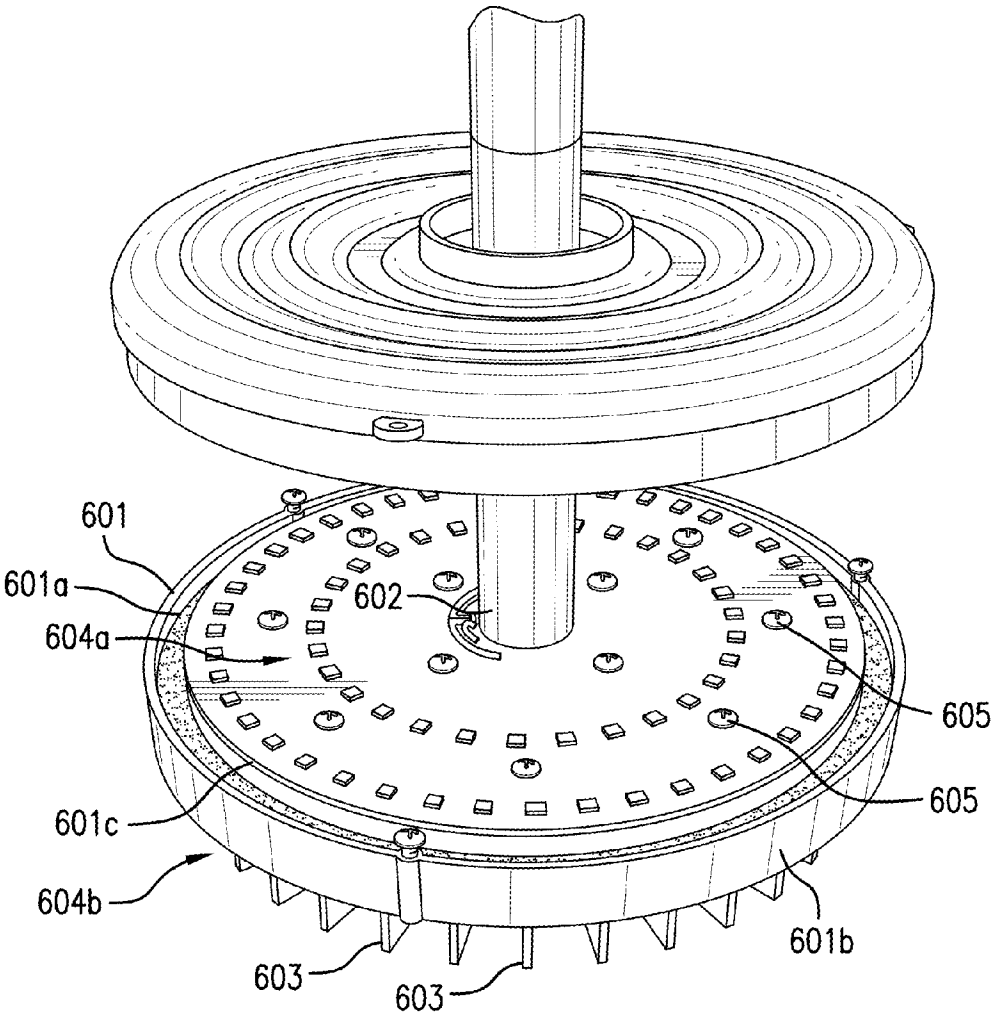
FIG. 6 illustrates the sealing of the heat sink, LED board, and annular lens assembly according one embodiment of the present disclosure.

As illustrated in the exemplary embodiment in FIG. 6, retro-fit assembly 101 contains an aluminum heat sink 102 provided with two circular planar surfaces 604*a* and 604*b*. Heat sink 102 is further provided with a peripheral annular wall 601 on the outer concentric edge of planar surface 604*a*, and a center opening 602 penetrating from planar surface 604*a* through to and stopping at the inner well of planar surface 604*b*.

Figure 7:
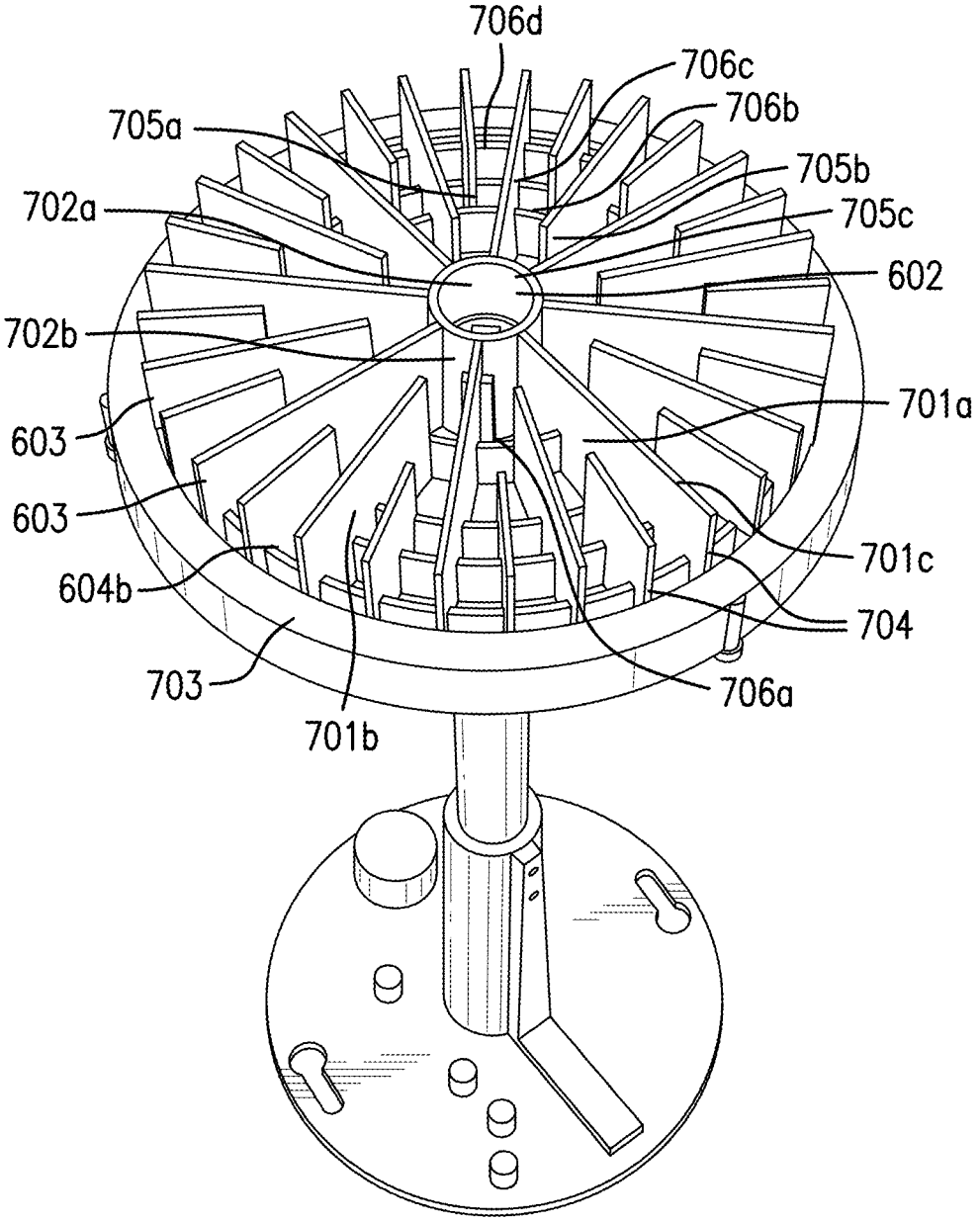
FIG. 7 illustrates a planar surface of the heat sink including a center opening, a plurality of cooling fins and concentric rims.

As illustrated in the exemplary embodiment in FIG. 7, center opening 602 is provided with an inner cylindrical surface 702*a* and an outer cylindrical surface 702*b*. Planar surface 604*b* of heat sink 102 is provided with concentric annular walls 706*a-d*. Planar surface 604*b* is further provided with radially arranged cooling fins 603 that extend outwardly from center opening 602. Cooling fins 603 are each provided with opposing planar surfaces 701*a* and 701*b* with a rounded top edge 701*c*, and are integrally connected to planar surface 604*b* of heat sink 104, for example, by being part of the same casting. Radially outward edges 704 of cooling fins 603 are integrally connected to the inner edge of rim 703 of planar surface 604*b* while a plurality of inner edges 705*a* of a plurality of cooling fins 603 are integrally connected to inner rim 706*b* of planar surface 604*b*, a plurality of radially inner edges 705*b* of a plurality of cooling fins 603 are integrally connected through to inner rim 706*a* of planar surface 604*b*, and a plurality of radially inner edges 705*c* of a plurality of cooling fins 603 are integrally connected to outer circular surface 702*b* of center opening 602.

In a preferred embodiment, peripheral annular wall 601 has an inner surface 601*a* and a corresponding outer surface 601*b* on the other side thereof. Peripheral annular wall 601 is formed by the cylindrical space between inner surface 601*a* and circular wall 601*c* that wraps around planar surface 604*a*. Peripheral annular wall 601 is provided with sufficient depth such that the outer wall 304 of sealing lens 104 can be inserted therein, wherein a liquid sealant, such as epoxy, or other suitable sealants, can be poured into the peripheral annular wall 601 of heat sink 102. In the exemplary embodiment, LED board 103 is secured onto the circular surface of heat sink 102 via screws in securing openings 103*b* and 605 on LED board 103 and heat sink 102, respectively, and riser pipe 105 is fitted through retro-fit assembly 101 via aligned center openings, including 103*h* of LED board 103, 602 of heat sink 102, and 403 of sealing lens 104. Concentric grooves 307*a* and 307*b* on the inner surface of sealing lens 104 are provided for clearing the heads of the screws secured in the securing openings 103*b* and 605 on LED board 103 and heat sink 102, respectively. Once epoxy is poured into the outer ring 601 of heat sink 102, sealing lens 104 is lowered into heat sink 102 and outer wall 304 is embedded in the epoxy, permanently sealing the outer edge of assembly 101, as shown in FIGS. 8 and 10.

Figure 9:
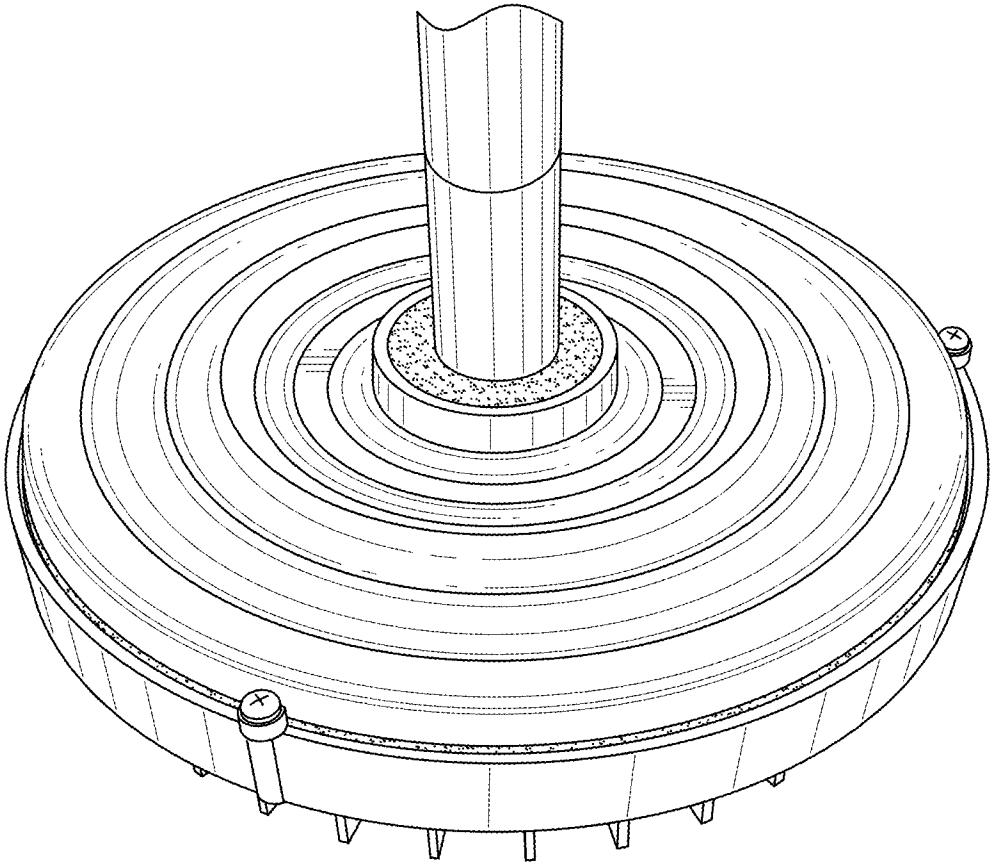
FIG. 9 illustrates yet another aspect of the permanent sealing of the assembly of the heat sink, LED board, and sealing lens.
Figure 10:
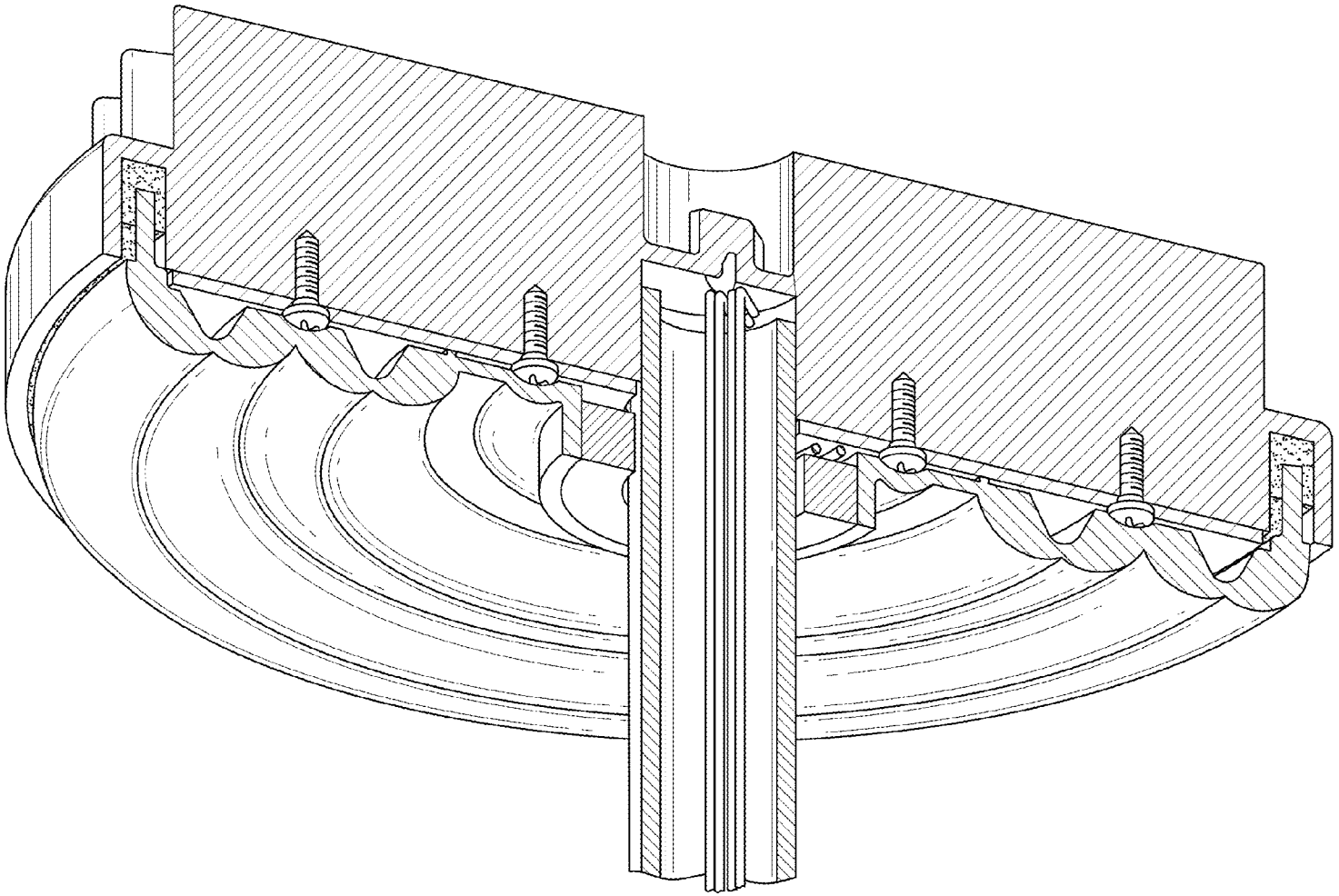
FIG. 10 illustrates a cross-sectional view of the permanently sealed assembly of the heat sink, LED board, and sealing lens.
Figure 11:
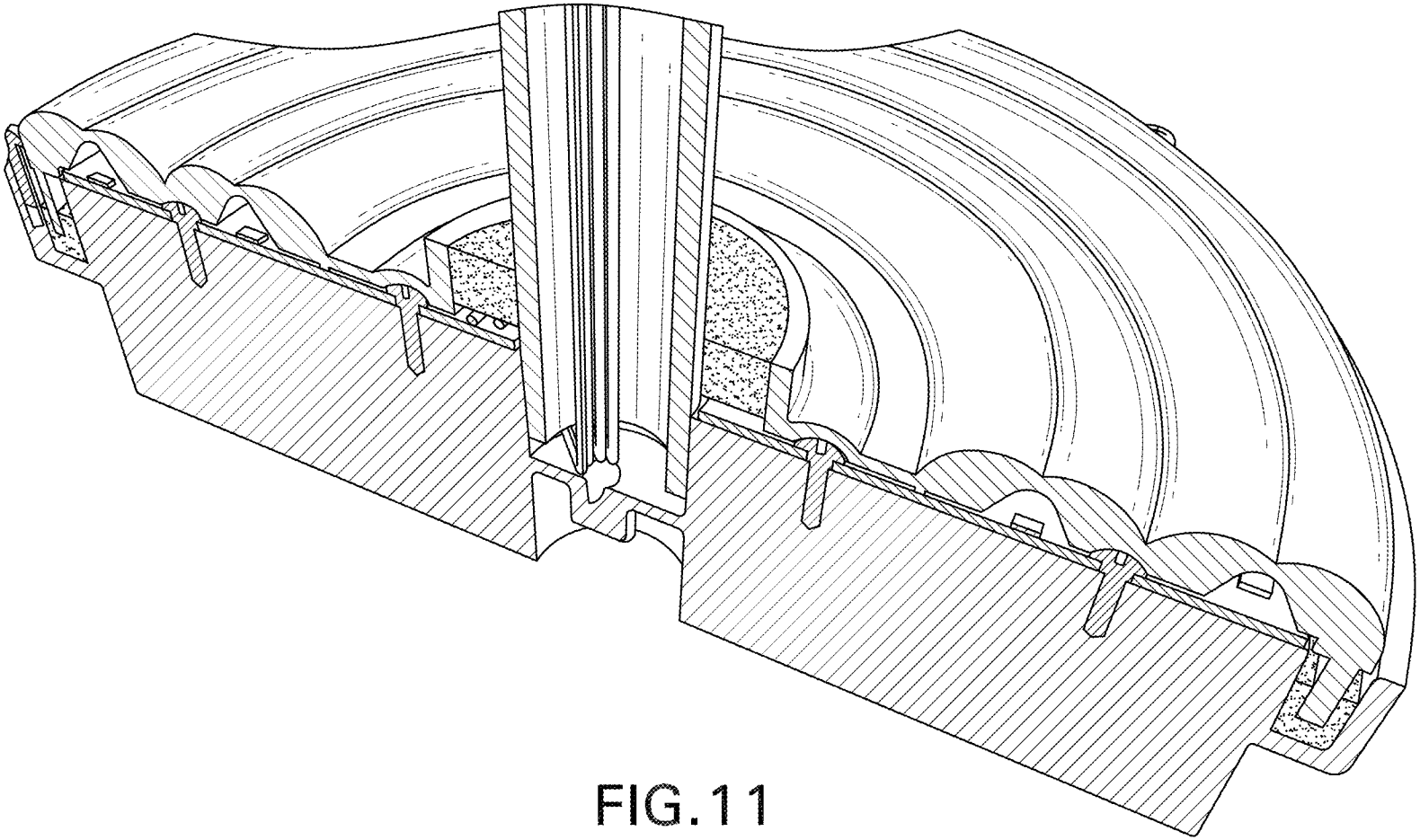
FIG. 11 illustrates another cross-sectional view of the permanently sealed assembly of the heat sink, LED board, and the sealing lens.

As further illustrated in FIG. 10, grooves 307*a* and 307*b* found on the inner surface of sealing lens 104 are filled with the sealant to ensure robust and permanent encapsulation. In a preferred embodiment, epoxy is then poured into the center opening of assembly 101, as shown in FIG. 9, and allowed to flow into inner well 606 of the heat sink up to a level measured on the outside of the riser pipe 105 to be sufficient to provide a robust sealing of the heat sink and sealing lens, as shown in FIG. 11. According to one embodiment of the present disclosure, the epoxy seal covers wires that conduct power, which are routed past riser pipe 105 and permanently seals inner edge of assembly 101, as shown in FIG. 10. In a preferred embodiment, heat sink 102 is designed to accommodate a passage 607 for conductive wires to route past riser pipe 105, as shown in FIG. 12. In another embodiment, rings or bumps can also be included on the inner edge of the heating sink to prevent epoxy from leaking into fully sealed air optical gap, as illustrated in FIG. 11.

Figure 8:
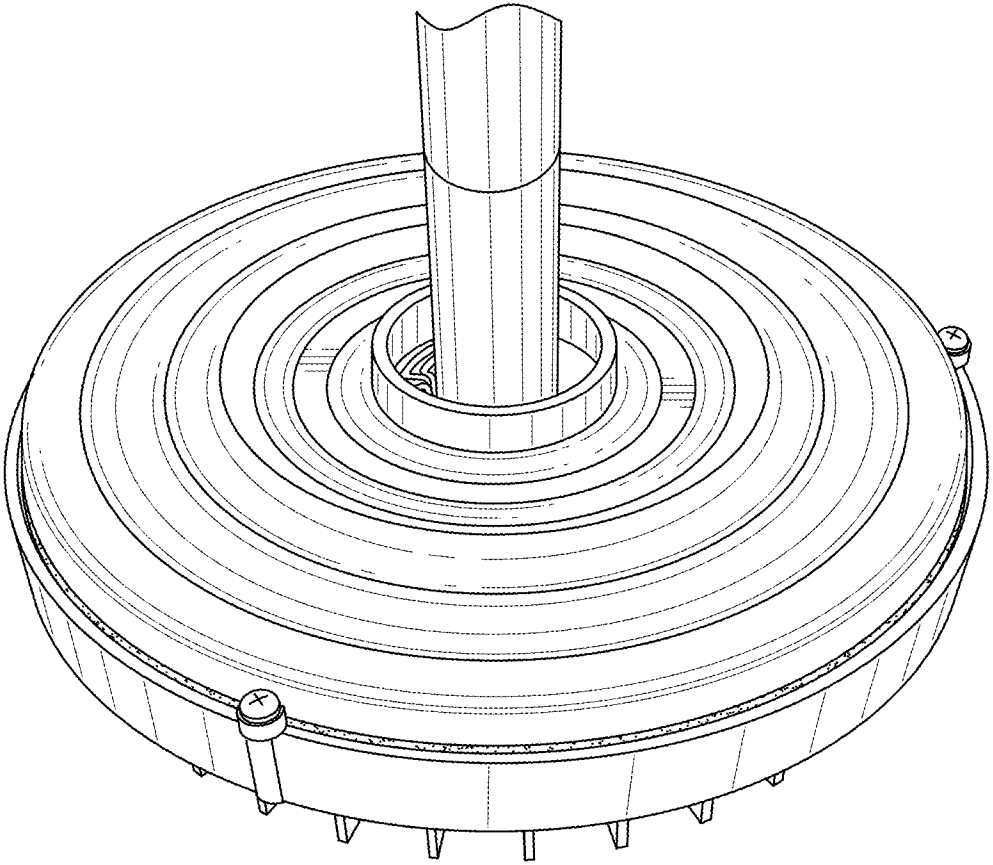
FIG. 8 illustrates another aspect of the permanent sealing of the assembly of the heat sink, LED board, and sealing lens.

As further illustrated in FIGS. 8 and 9, other than using a sealant to seal the assembly of heat sink 102, LED board 103 and sealing lens 104, the assembly is further secured on the outer edges via screws fastened into securing openings 402 on outer wall 304 of lens 104 and corresponding securing openings 609 on periphery 608 of heat sink 102.

In accordance with the present disclosure, the retro-fit LED lighting system further includes an adaptor casting 106 that mounts to industry standard fixtures.

As illustrated in the exemplary embodiment in FIG. 1, the top side 106*a* of adaptor casting 106 is provided with a hollow shaft 106*e* for receiving riser pipe 105 thereby providing adjustable height the retro-fit LED system. In the illustrated embodiment, the bottom side 106*b* of adaptor casting 106 is equipped with brackets 106*c* for retaining LED driver 107 in place. Adaptor casting 106 is fitted to industry standard fixture fitters via, for example, securing openings 106*d* and threaded fasteners.

In accordance with the present disclosure, the illustrated retro-fit LED lighting system further includes a LED driver 107.

Figure 13:
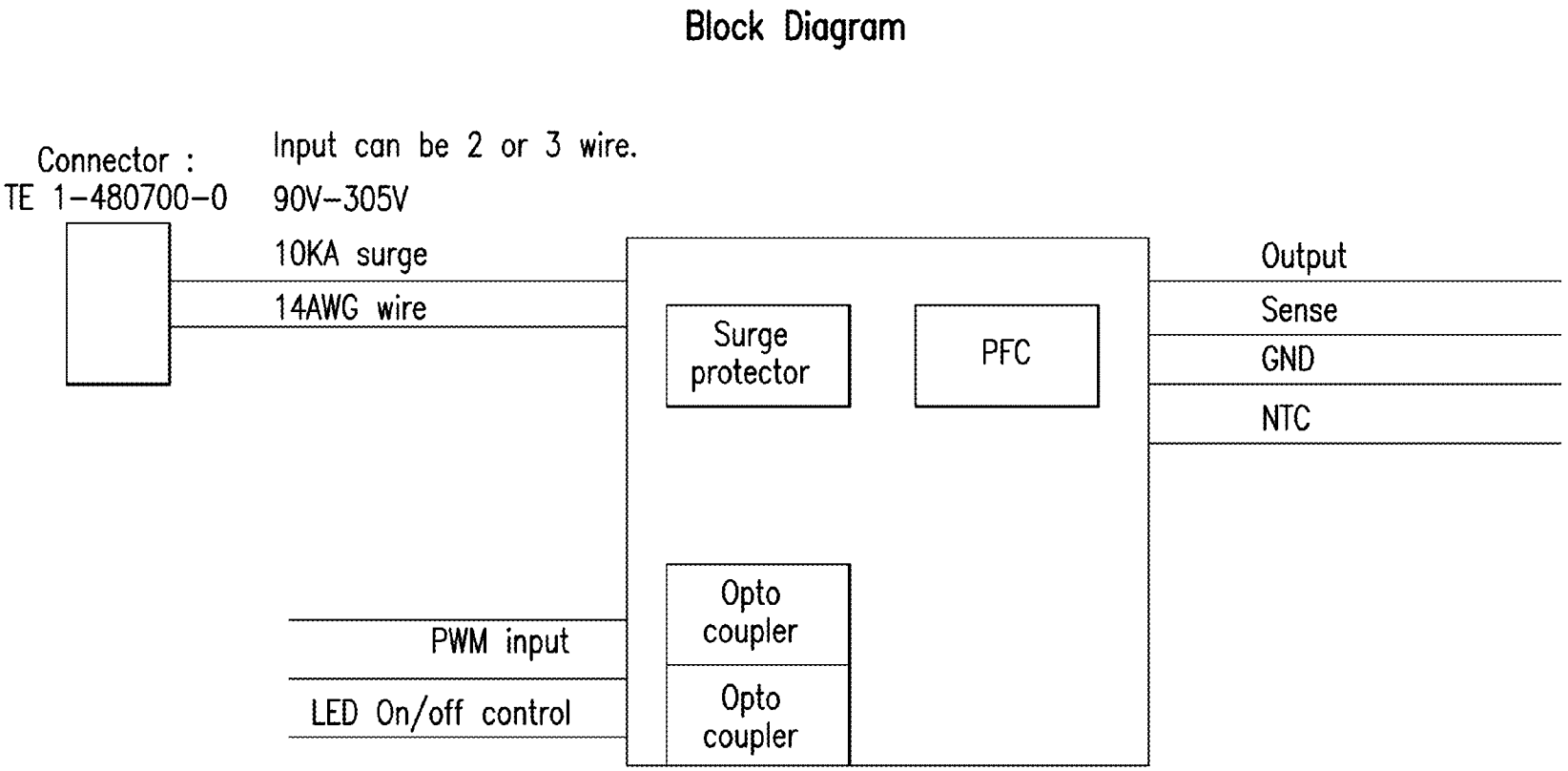
FIG. 13 is a block diagram showing an exemplary implementation of electrical power flow in an embodiment of the present disclosure.
Figure 14:
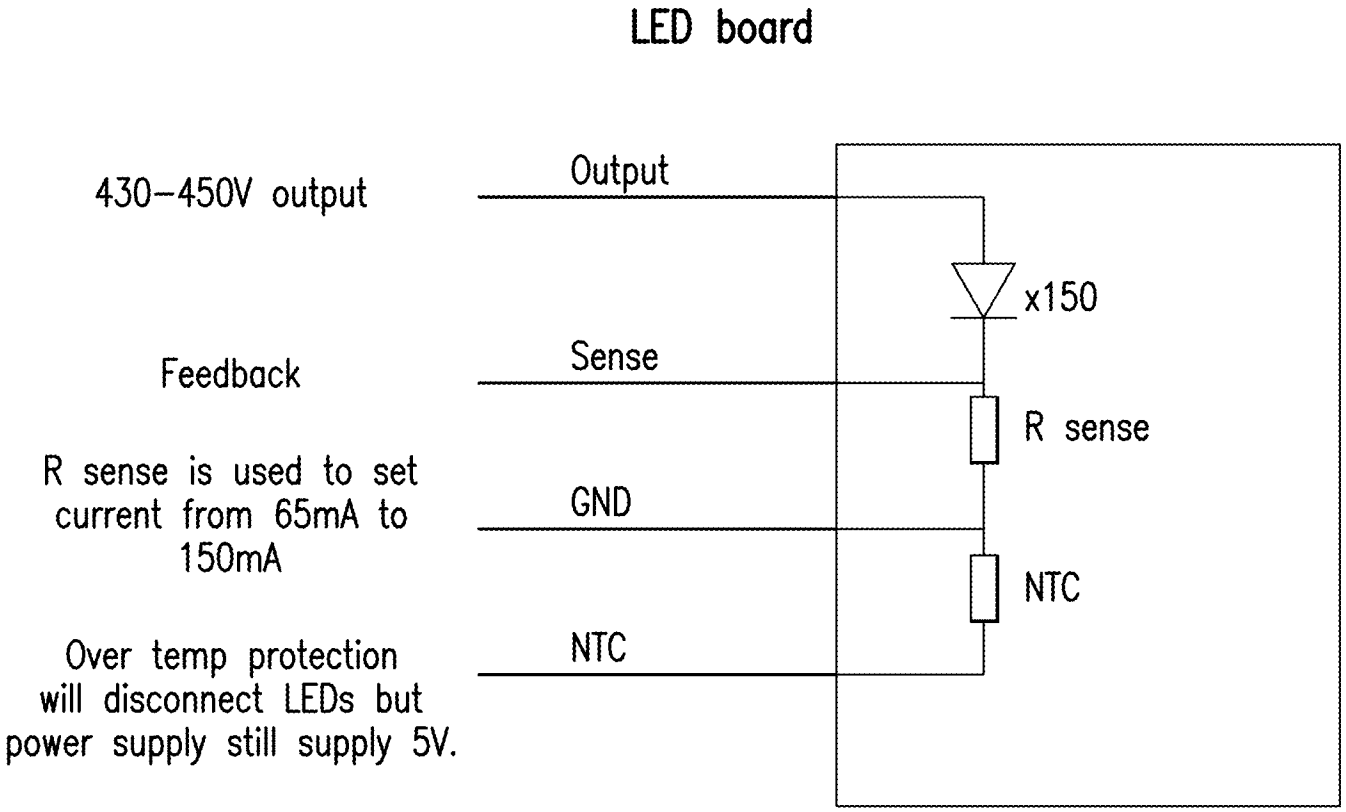
FIG. 14 is a high level block diagram showing one embodiment of a LED board of the present disclosure.
Figure 15:
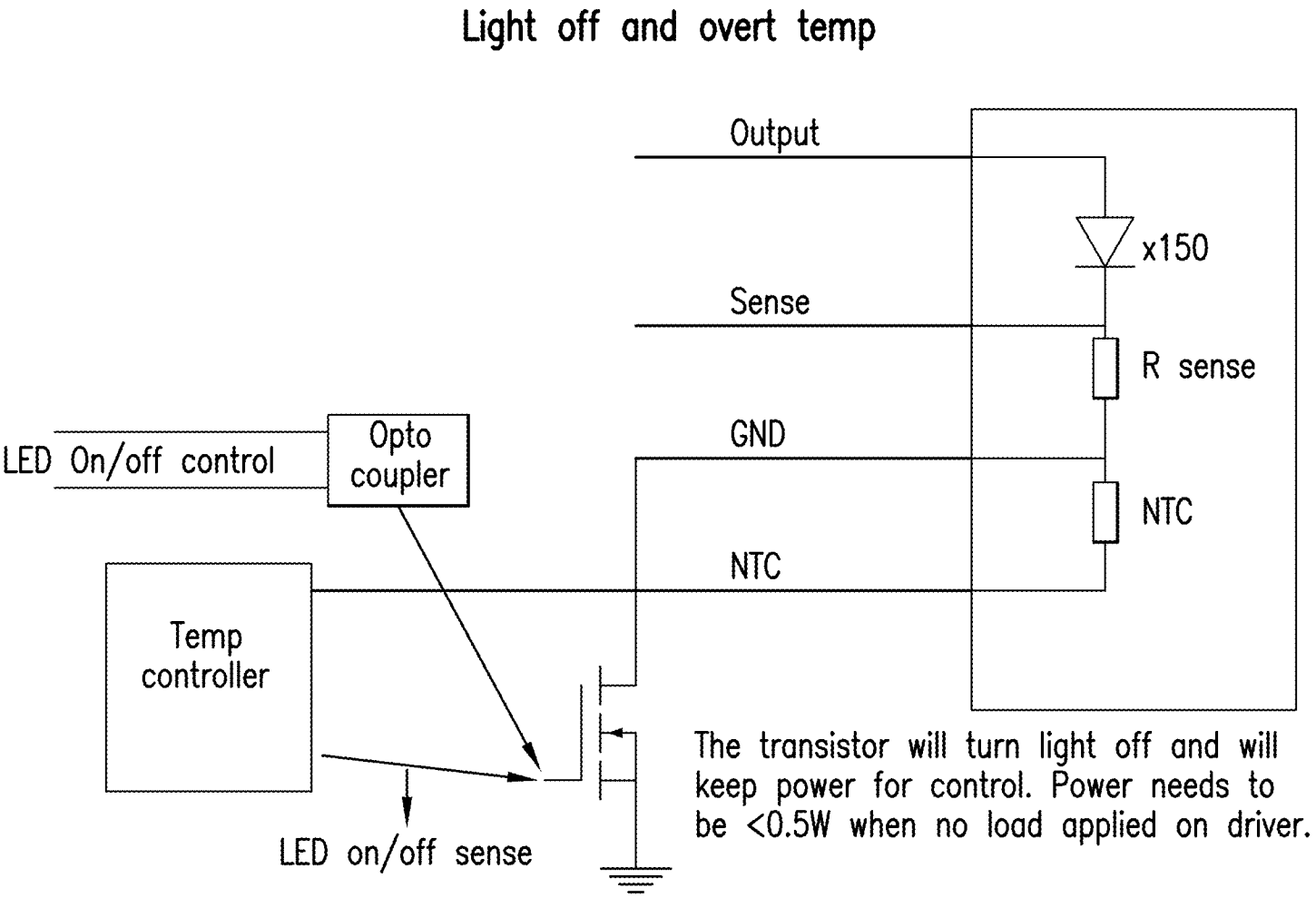
FIG. 15 illustrates the electrical circuit arrangement for the on/off and temperature maintenance functions of an embodiment of the present disclosure.

As illustrated in FIG. 13, LED driver 107 can be a high voltage PFC driver with the electrical current set to be between 65 mA to 150 mA by a R sense resistor, which can be external to the lighting system's power supply. As shown in FIG. 14, the LED driver 107 can include a Negative Thermal Coefficient Resistor (NTC) to measure and maintain temperature of the retro-fit lighting system. In a preferred embodiment, as shown in FIG. 15, in response to an indication of system overheat by a temperature controller, LEDs will be disconnected, but the power source will continue to supply at least 5V to keep the system in standby mode so that electrical controls remain charged while LEDs are off.

The LED assembly generally includes one or more LEDs or one or more groups of the LEDs electrically arranged as one or more series networks, parallel networks, or a combination of series and parallel networks of LEDs. In the illustrated embodiment, the LED assembly includes 150 LEDs, each having a voltage drop between 2.9 to 3.4V, electrically arranged in a series network.

According to another aspect of the present disclosure, the electrical input for the illustrated embodiment, as illustrated in FIG. 13, can include a connector, which can be, for example, TE 1-480700-0, and multiple input wires, including ones for a 10 KA surge protector to provide protection against lightning, and a 14 AWG wire. For retro-fitting outdoor lighting systems, a surge protector of 10 KA is useful. For indoor retro-fitting systems, a surge protector of 1.5 KA or 3 KA is acceptable. For on/off control, LED driver 107 can include a PWM input which controls the input current and limits output current under predetermined conditions, such as standby or off modes. With the example PWM input, the output current is kept to be proportional to the duty cycle of the PWM. In a preferred embodiment, as shown in FIG. 12, and in more detail in FIG. 14, opto couplers can be operably connected to input controls such that the on/off function of LEDs can be operated via a wireless remote control. LED driver 107 can also include a booster circuit of 453V DC, for example, to increase the voltage of the circuit. A ground protector can be included to work in conjunction with the surge protector to ground surge currents, from, for example, lightning.

The LED driver 107 is preferably an electronic module that regulates the light output of the LED lighting system 100 by providing and controlling electric power (e.g., voltages, currents and timing of applied voltages) to the LED assembly. In some embodiments, the LED driver 107 can be a stand-alone module or may alternatively be an assembly of component modules, such as wired or printed circuit boards (PCBs), integrated circuits (ICs), or a combination thereof.

The LED driver 107 may receive commands from and/or provide feedback signals to the LED board 103, as well as incorporate portions thereof. Functions of the LED driver 107 can include, for example, at least one of (i) turning the retro-fit lighting system 100 on or off, (ii) changing or modulating the intensity of the produced illumination, (iii) performing in-situ optical, electrical, or mechanical adjustments, and (iv) reporting on operational status/performance of components of the retro-fit lighting device 100.

Figure 16:
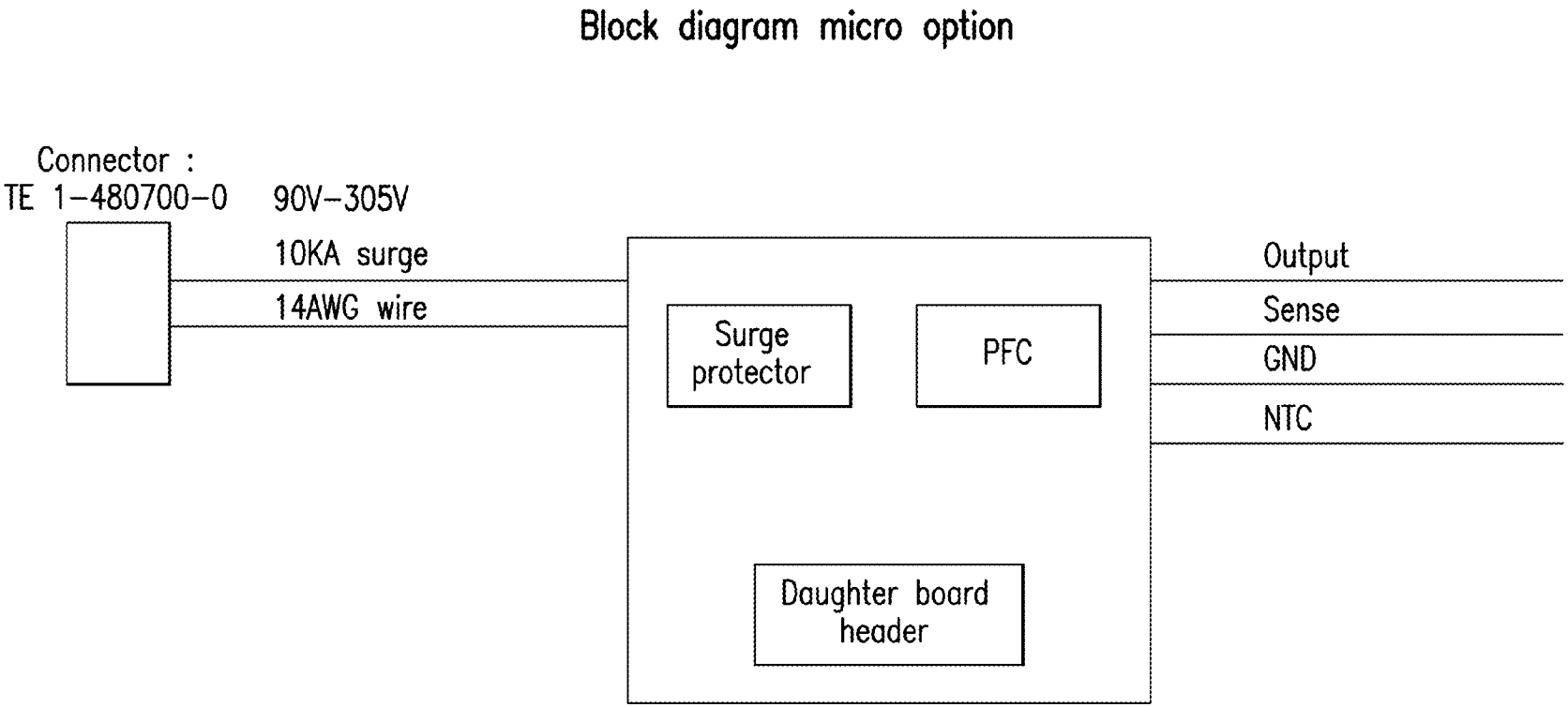
FIG. 16 illustrates another embodiment of the electrical input and output of an embodiment of the present disclosure.
Figure 17:
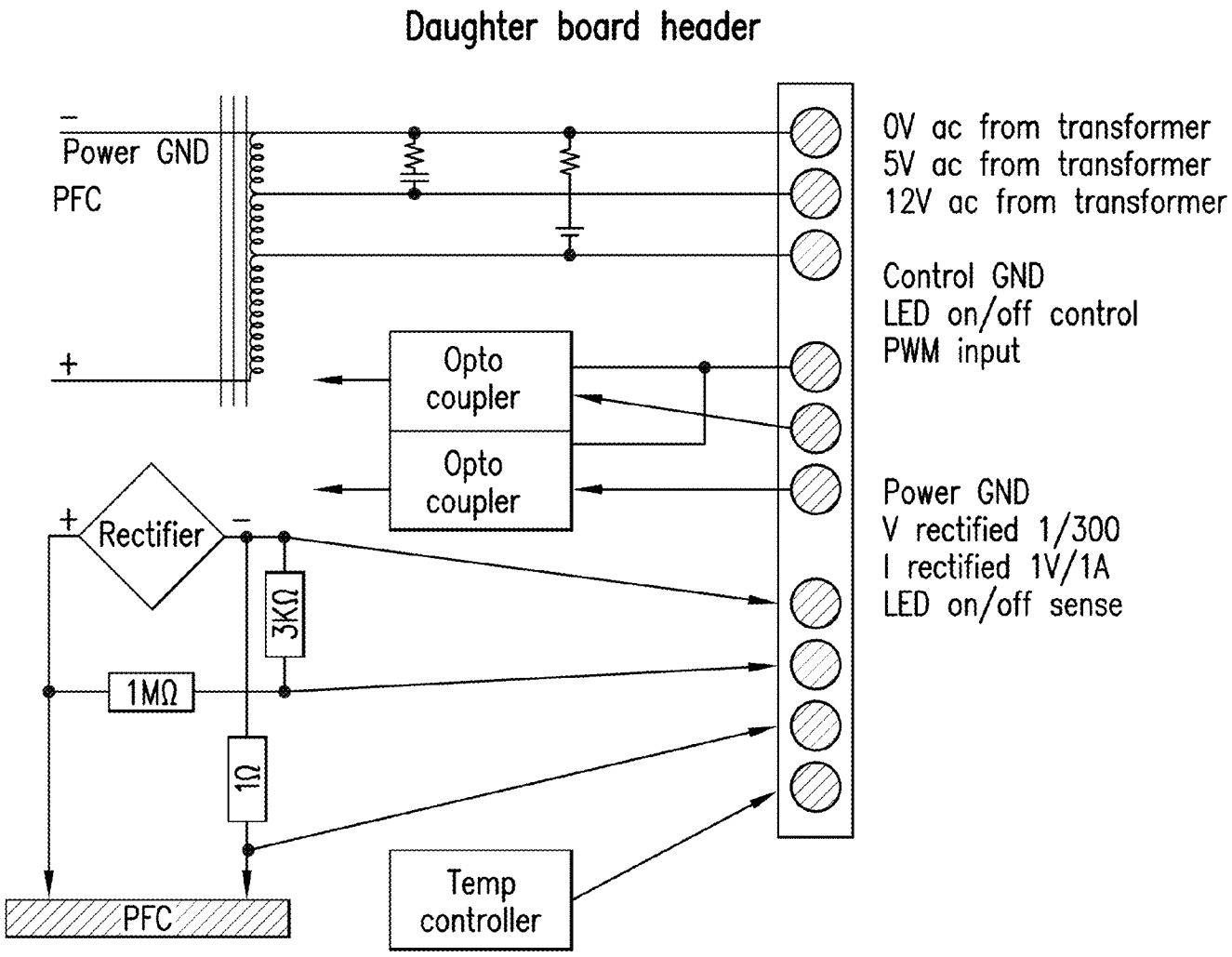
FIG. 17 illustrates an exemplary daughter board for connection to the LED driver according to one embodiment of the present disclosure.

Additionally, LED driver 107 may also receive commands from and/or provide feedback signals to a daughter board with a generic connector to the driver, as shown in FIG. 16. An illustration daughter board, as illustrated in FIG. 17, can contain a predetermined set of functions and communication protocols that control the LED driver, and may be replaced with another daughter board with yet another set of protocols for the LED driver. Functions and communication protocols on an illustration daughter board can include an on/off sensor and controller, temperature controller, current and voltage measurement, and other standard functions.

Reference will now be made to describe a representative method of using an embodiment of the present disclosure. The method includes securing a LED circuit board on one planar surface of a heat sink wherein the heat sink contains a ring on the outer edge with sufficient depth to receive a liquid sealant and to fit an outer edge of an optical sealing lens, and an opening in the center to which a riser pipe can fit. The method can also include placing a riser pipe through the opening in the center of the heat sink and placing a sealant into the ring on the outer edge of the heat sink. The method can also include depressing the optical sealing lens into the ring on the outer edge of the heat sink wherein the outer edge of the lens is embedded in the sealant, and the outer edges of the heat sink and the lens are permanently sealed together. The method can also include placing another sealant into the inner well of the heat sink formed by the opening in the center of the heat sink, whereby conductive wires routed through the inner well are covered by the sealant and the inner edge of the inner well is permanently sealed. The method can also include fitting an adaptor casting around the riser pipe wherein the adaptor casting is mountable to industry standard lighting fixtures fitters.

As embodied herein and with specific references to FIGS. 1-12, the methods of the present disclosure include providing retro-fit lighting systems 100 as detailed above.

In accordance with the method of the present disclosure, LED circuit board 103 can be coupled to heat sink 102 via screws fastened into securing openings 103*b* on LED board 103 and securing openings 605 on heat sink 102. Heat sink 102 can include outer ring 601 formed as the cylindrical space between inner surface 601*a* and circular wall 601*c*. Outer ring 601 can be provided with sufficient depth to receive a liquid sealant and to fit outer wall 304 of sealing lens 104.

In further accordance with the method, riser pipe 105 can placed through center openings 602 of heat sink 102, 103*h* of LED board 103, and 403 of sealing lens 104, which are aligned to receive riser pipe 105.

In further accordance with the method, a liquid sealant, such as, for example, epoxy, can be poured into outer ring 601 of heat sink 102. Once the sealant is placed into outer ring 601, sealing lens 104 is lowered into the ring whereby outer wall 304 of sealing lens 104 is embedded into outer ring 601 containing the sealant. The outer edges of heat sink 102 and sealing lens 104 are accordingly permanently sealed together.

In further accordance with the method, once the outer edges of heat sink 102 and sealing lens 104 are permanently sealed, another liquid sealant, such as epoxy, can be poured into inner well 606 of heat sink 102, where conductive wires are routed past riser pipe 105 via passage 607. Sealant can be poured into inner well 606 to a level measured on the outside of riser pipe 105 to be sufficient to provide a robust sealing of inner well 606.

In further accordance with the method of the present disclosure, adaptor casting 106 can be mounted onto riser pipe via its hollow shaft 106*e* receiving riser pipe 105 on planar surface 106*a* of adaptor casting 106.

In further accordance with the method of the present disclosure, the height of retro-fit lighting system 100 can be adjusted by moving riser pipe 105 against receiving shaft 106*e* of adaptor casting 106.

In further accordance with the method of the present disclosure, a LED driving circuit can be retained onto planar surface 106*b* of adaptor casting 106 of retro-fit lighting system 100 to provide power and electrical control to system 100.

Figure 18:
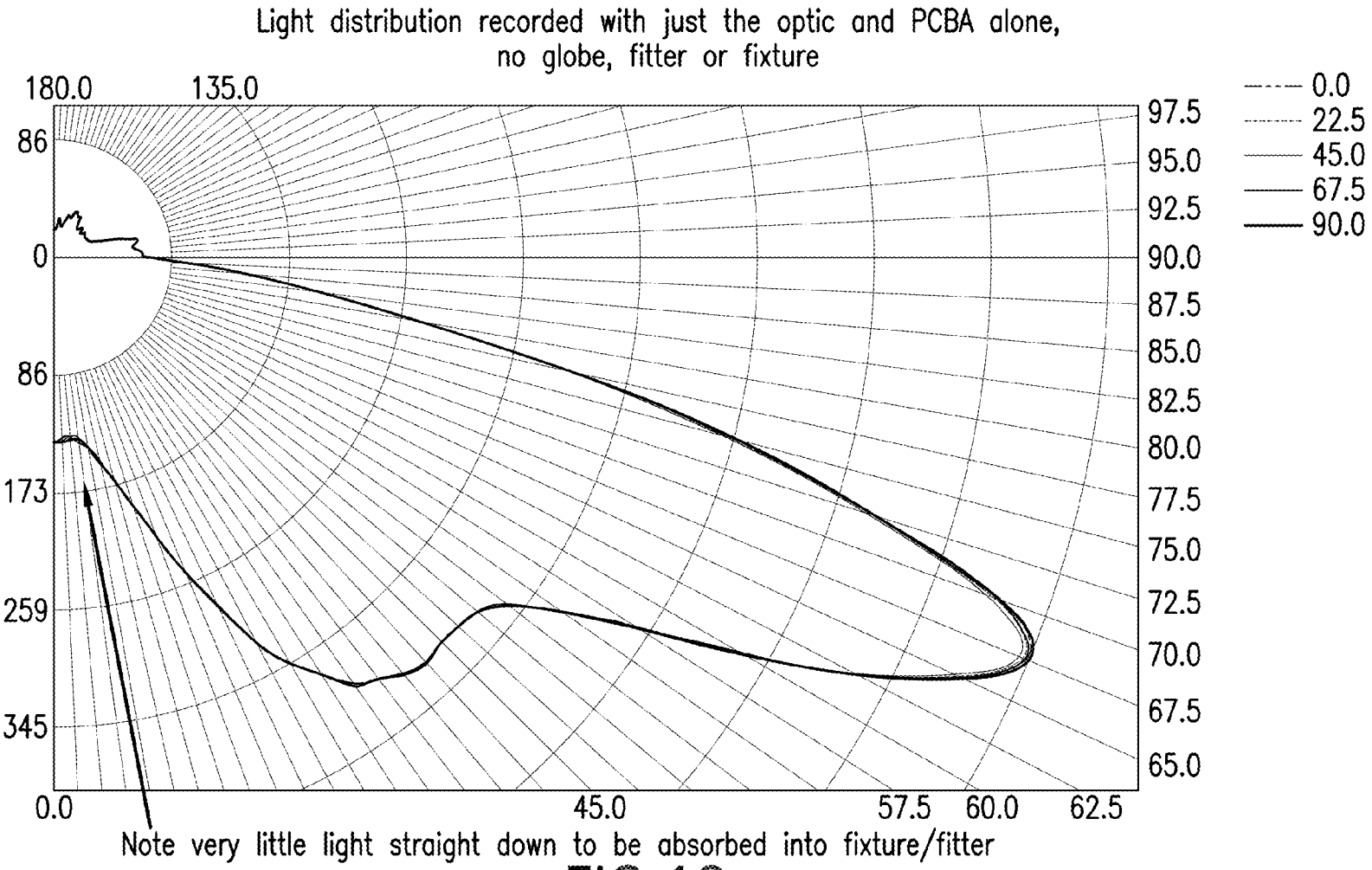
FIG. 18 is a polar plot showing the physical downward distribution of light according to one embodiment of the present disclosure.
Figure 19:
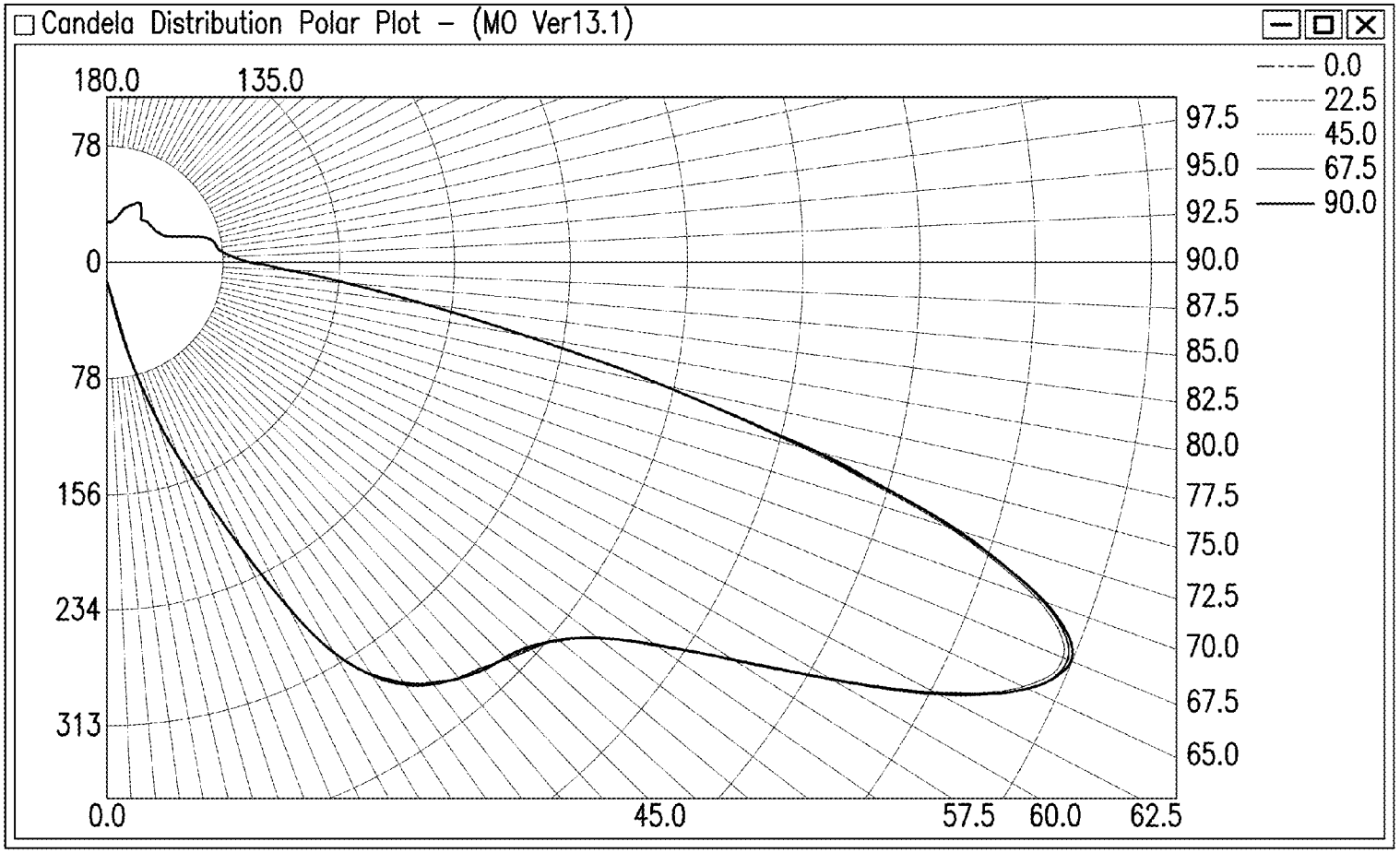
FIG. 19 is another polar plot showing the distribution of light according to one embodiment of the present disclosure.

FIGS. 18 and 19 are polar plots showing light distributions according to a preferred embodiment of the present disclosure. FIG. 18 illustrates light distribution without any fixture fitted over the lighting system, and FIG. 19 illustrates light distribution with a complete globe fixture fitter. Both plots show very limited illumination above or below the 0 degree line, indicating that most of the illumination is captured and distributed, optimally, between the 0 to 90 degree angle from the lighting post.

Although the present disclosure herein has been described with reference to particular preferred embodiments thereof, it is to be understood that these embodiments are merely illustrative of the principles and applications of the disclosure. Therefore, modifications may be made to these embodiments and other arrangements may be devised without departing from the spirit and scope of the disclosure.

What is claimed is:

1. A retro-fit lighting system, comprising:

at least one lighting device electrically coupled to a power supply, the at least one lighting device comprising (i) a light emitting diode (LED) driving circuit powered using the power supply, (ii) at least one sealed LED assembly controlled by the light emitting diode (LED) driving circuit, (iii) a riser, and (iv) an adaptor casting mounted to a fixture and the riser, wherein the light emitting diode (LED) driving circuit is a Power Factor Correction Stage directly connected to a plurality of light emitting diodes (LED) electrically arranged in a series network;

wherein the at least one sealed LED assembly includes an optical sealing lens that is a bubble optic rotated in parallel concentric rings; and wherein the optical sealing lens is shaped substantially as a plurality of adjacent crescent waves with a plurality of concentric toroidal surfaces at the bottom of the waves.

2. The system of claim 1, wherein the sealed LED assembly includes at least one of (a) a heat sink, (b) an optical sealing lens, and (c) a LED circuit board.

3. The system of claim 2, wherein the heat sink includes a passage for routing wires past the riser.

4. The system of claim 2, wherein the heat sink includes a ring on an outer concentric edge with sufficient depth for receiving a sealant and fitting an outer concentric edge of the optical sealing lens.

5. The system of claim 2, wherein the heat sink includes cast aluminum.

6. The system of claim 2, wherein the LED circuit board includes the plurality of LEDs arranged in two concentric rings, and the optical sealing lens includes two concentric channels that align with the concentric rings of LEDs.

7. The system of claim 2, wherein the LED circuit board is secured onto a planar surface of the heat sink and sealed by the optical sealing lens.

8. The system of claim 1, wherein parallel concentric rings on an inner surface of the optical sealing lens capture light emitted from the LEDs.

9. The system of claim 1, wherein an outer surface of the optical sealing lens includes parallel concentric grooves that distribute light emitted from the LEDs.

10. The system of claim 1, wherein the riser includes polished aluminum.

11. The system of claim 1, wherein the adaptor casting includes a hollow shaft for receiving the riser.

* * * * *